US007097570B2

(12) United States Patent
Gulyassy

(10) Patent No.: US 7,097,570 B2
(45) Date of Patent: Aug. 29, 2006

(54) POOL CUE

(76) Inventor: Michael Gulyassy, 109 A Miller Rd., Mauldin, SC (US) 29662

( * ) Notice: Subject to any disclaimer, the term of this patent is extended or adjusted under 35 U.S.C. 154(b) by 0 days.

(21) Appl. No.: 10/334,626

(22) Filed: Dec. 31, 2002

(65) Prior Publication Data

US 2003/0166419 A1 Sep. 4, 2003

Related U.S. Application Data

(60) Provisional application No. 60/346,369, filed on Jan. 7, 2002.

(51) Int. Cl.
*A63D 15/12* (2006.01)

(52) U.S. Cl. ..... 473/49

(58) Field of Classification Search ..... 473/44–49
See application file for complete search history.

(56) References Cited

U.S. PATENT DOCUMENTS

| | | | | | |
|---|---|---|---|---|---|
| 125,643 | A | * | 4/1872 | Wilbur, Jr. | 473/49 |
| 192,044 | A | * | 6/1877 | Hill | 473/49 |
| 278,934 | A | * | 6/1883 | Gleason | 473/49 |
| 983,938 | A | * | 2/1911 | Schuermann | 473/49 |
| 1,560,456 | A | * | 11/1925 | Wolpert | 473/44 |
| 2,544,970 | A | * | 3/1951 | Watson | 473/49 |
| 5,016,877 | A | * | 5/1991 | Lowery | 473/51 |
| 5,326,329 | A | | 7/1994 | Doss | |
| 5,820,473 | A | * | 10/1998 | Lambros | 473/44 |
| 5,938,536 | A | * | 8/1999 | Minke | 473/49 |
| 6,251,024 | B1 | | 6/2001 | Summers et al. | |

FOREIGN PATENT DOCUMENTS

| | | | |
|---|---|---|---|
| GB | 2226251 | A * | 6/1990 |
| GB | 2254794 | A * | 10/1992 |

* cited by examiner

*Primary Examiner*—Mark S. Graham
(74) *Attorney, Agent, or Firm*—D. Peter Hochberg; Sean Mellino; Katherine R. Vieyra

(57) ABSTRACT

A cue stick for use in the game of billiards having a one-piece ferrule-tip. The cue stick does not employ a conventional wood cue tip but rather has a modified ferrule-tip which serves as a resilient tip for striking a cue ball. The cue stick of the present invention has one embodiment for causing a struck cue ball to be jumped over an obstructing ball by elevating the handle of the cue stick to an appropriate height, which is lower than if a conventional cue stick were used, and striking the cue ball at an appropriate angle with an appropriate amount of force, which is less than if a conventional cue stick were used. The cue stick having a ferrule-tip of the present invention thus enables the player to strike a cue ball with a lower elevated angle and less force than with a conventional cue stick having a conventional tip, thereby facilitating the ball-jumping effect.

3 Claims, 5 Drawing Sheets

POOL CUE

CROSS REFERENCE TO RELATED APPLICATION

This application claims priority of U.S. Provisional Application No. 60/346,369, filed Jan. 7, 2002, under Title 35, United States Code, Section 119(e).

FIELD OF THE INVENTION

The present invention relates generally to pool cues. More particularly, the present invention relates to pool cues or jump/break cues having a ferrule-tip rather than a conventional, multi-piece ferrule. The invention is a pool cue with a one-piece ferrule tip for causing a pool ball to jump over an obstructing ball, as well as to break a rack of balls.

DESCRIPTION OF THE PRIOR ART

Cues, also called billiard cues or pool cues, are commonly employed in the popular games of billiards, pool and the like. Players of the games generally use the cue, which typically has a handle end and a striking end for shooting, or hitting, a cue ball into other balls for purposes of placing the other balls into pockets that are located on the pool table, or to be placed near other balls in the game of billiards. The striking end of the cue conventionally comprises a ferrule made of a phenolic, plastic or metal and having a tip made of leather or a comparable synthetic material, which often becomes worn or even breaks due to extended use or misuse. The assembly of a tip and a ferrule is constantly in need of repair, particularly with replacing the tip held in place by the ferrule.

Often times during the course of play, the situation arises where the player desires to strike a particular, ball that is being obstructed or blocked by the ball of an opponent, or by another ball of the player's own, that is not intended or desired to be hit. To avoid hitting the ball of the opponent, or any other obstructing ball, "jumping" the cue ball over the obstructing ball is sometimes practiced, thereby striking only the intended ball.

Striking the cue ball with the cue's tip being angled appropriately by holding the handle end of the cue at an elevated angle generally causes the ball to jump. In other words, the cue stick strikes the cue ball (or other desired ball) at a relatively sharply elevated angle and with a simultaneous downward and forward motion and with an increased amount of force. Upon proper execution of this task, the cue ball will jump off the table, avoid contact with the obstructing ball, and successfully strike the desired ball. This, however, requires a considerable amount of skill and hours of practice to successfully perform. Because of the high level of skill involved, the player often times will run the risk of not hitting his own ball with the cue ball and will instead strike the obstructing ball, or even another ball on the table not intended to be struck. The player also runs the risk of mis-striking the cue ball with the cue and hitting the cue tip against the table. This of course can cause damage to the cue tip itself due to the tremendous force generated to cause the ball to jump. Additionally, hitting the table with the cue can rip or tear the delicate felt cloth material that traditionally covers pool tables.

One method of jumping cue balls is described in U.S. Pat. No. 5,326,329 (Doss). Doss '329 describes a modified cue stick having a significantly shortened length, approximately one half that of standard cue sticks, and having a plurality of weights placed in the handle of the stick, and having a tip. However, the invention described in Doss '329 still requires the player to elevate the stick at approximately a forty five degree angle to the table and thrusting the cue stick downwardly. Therefore, Doss '329 does not solve the problem that the present invention seeks to solve.

U.S. Pat. No. 6,251,024 B1 (Summers et al.) describes a pool cue having a modified tip for purposes of jumping a cue ball over an obstructing ball. The tip of the pool cue of Summers et al. '024, which is made of a resilient material, comprises a concave depression. It is the combination of the concave depression with the particular shore hardness of the resilient material that serves to provide the control and performance characteristics of the invention of Summers et al. '024. The tip can also either be permanently placed on the cue stick or can be removable so that varying tips providing varying jumping ability and control can be employed, depending on the particular situation at hand.

SUMMARY OF THE INVENTION

In accordance with the preferred embodiments of the invention, there is provided a pool cue device or jump/break cue for use with the games of billiards, pool and the like, having a conventional shaft and having a modified and improved striking end region. The striking end region of the pool cue comprises a tipless end (i.e. not having a standard tip) or a non-compressible ferrule that is the tip. In other words, the ferrule-tip itself serves the same function as a conventional tip in that it strikes a cue ball. The ferrule-tip is a rounded tip for striking purposes. Unlike prior art cues, the ferrule-tip is not separate from the tip—it is the tip. Unlike conventional tips, the ferrule-tip does not suffer as much stress and thus, in most cases, will never need to be repaired, and in many cases never need to be replaced. The ferrule-tip is non-compressible, and transfers its eneruv to a cue ball upon striking the cue ball.

The ferrule-striking end provides the player with an improved device for purposes of jumping cue balls over an opponent's ball or another obstructing ball during play. For example, the cue ball could be about 12 inches from the obstructing ball. Jumping would be accomplished by having the user elevate the handle end to no more than a forty-five degree angle and striking the cue ball with a relatively downward motion. Of course the closer the cue ball is to the obstructing ball, the greater the elevation the pool cue's handle would have to be. Conventional cues having standard tips necessitate a tremendous amount of force to be generated by the user to cause the ball to jump. The present invention requires much less force to be generated and requires a lower angle of elevation for the feat to be accomplished. In other words, when attempting to jump the cue ball over an obstructing ball at a given distance away from the cue ball, the player will need to strike the cue ball with less force and hold the cue stick of the present invention at a lower angle of elevation than if the player wanted to jump the cue ball over an obstructing ball at the same given distance and using a conventional cue stick. The ferrule-tip provides a more efficient energy transfer from the cue stick to the cue ball, and thus executes the jump in an easier manner due to a greater force being exerted onto the ball. The principal of applying a greater force on the ball also applies to the break (however, a standard angle of elevation for breaking still applies).

It is an object of the present invention to provide a pool cue having a ferrule that is the striking tip.

It is another object of the present invention to provide a pool cue having a tip that generally never needs to be repaired or replaced.

Yet another object of the present invention to provide a pool cue modified to facilitate the jumping of a cue ball over an obstructing ball.

Still yet another object of the present invention is to provide a pool cue that generates a greater force on the cue ball which the pool cue is being used to strike.

Yet another object of the present invention is to provide a pool cue that provides a more efficient transfer of energy to the cue ball which the pool cue is being used to strike.

It is still yet another object of the present invention to provide a pool cue that allows a player to jump a cue ball over the obstructing ball by raising the handle of the cue to a lower degree of elevation than is traditionally used and striking the cue ball with a downwardly angled motion, the motion generating a lesser amount of force on the ball being struck than is traditionally used.

Still yet another object of the present invention is to reduce the components of a cue stick by combining the ferrule with the head of the cue stick.

Other objects of the present invention will become apparent from the description to follow and from the appended claims.

DETAILED DESCRIPTION OF THE PREFERRED EMBODIMENTS

Figure 1:
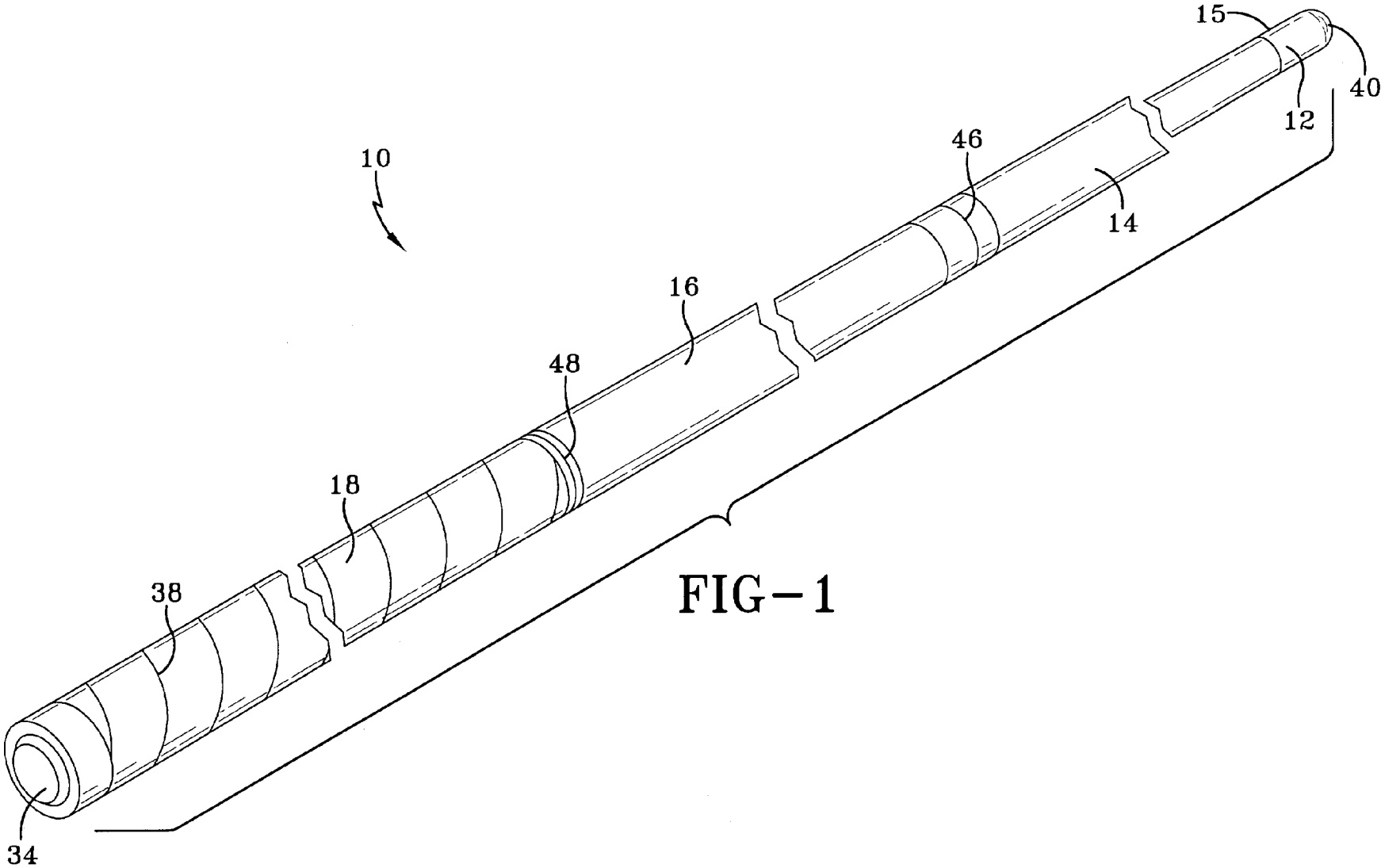
FIG. 1 is a perspective view of the jump shot device of the present invention.

The present invention is now described with reference to the drawings, wherein like reference numerals are used to refer to like elements throughout. In the following description, for purposes of explanation, numerous specific details are set forth in order to provide a thorough understanding of the present invention. It will be evident, however, to one skilled in the art that the present invention may be practiced without these specific details.

Turning now to FIG. 1, the pool cue of the present invention is shown and referred to generally at numeral 10. Cue 10 comprises a conventional, elongate, first member or shaft 14 having a striking end 15, a conventional second, elongate member or butt 16 and a conventional third, elongate member or handle 18. Shaft 14 is engaged with butt 16, which in turn is engaged with handle 18 to form a single and contiguous device 10. Of course the objects of the present invention can still be attained having device 10 comprise just two separate members, or be a single piece having no individual members, or even have more than three individual members. Device 10, having all three members engaged, generally has a length of about 58 inches. However, it is noted that pool cues are often custom made to fit a particular player's individual needs and so device 10 can be of any length common in the art.

Figure 2:
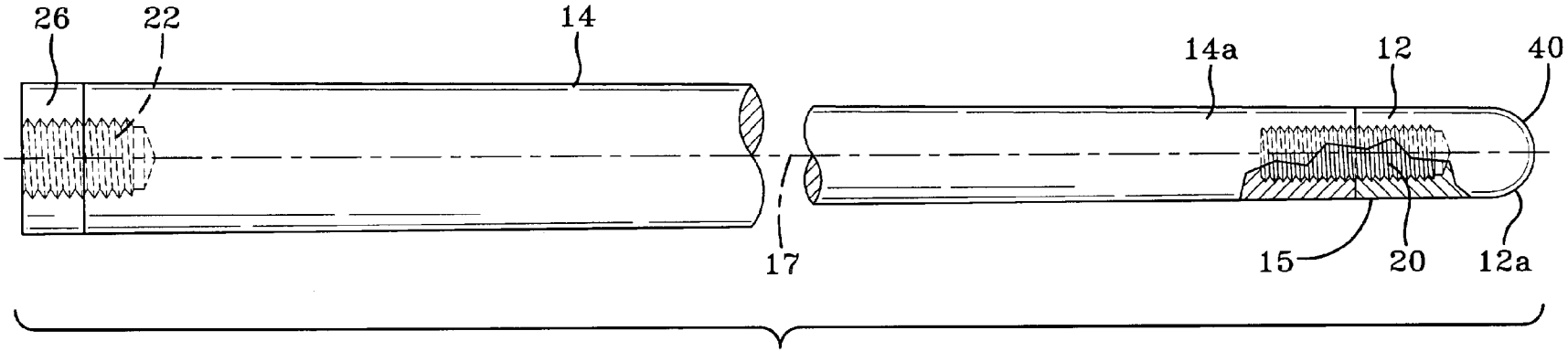
FIG. 2 is a side view of the upper portion or shaft of the jump shot device as shown in FIG. 1.

Turning now to FIG. 2, a more detailed description of the pool cue device 10 is provided. Shaft 14 comprises generally about one-half, or about 29 inches, of the total length of device 10. Shaft 14 is an elongate, annular member having a circular cross section and an annular outer surface 14*a*, which is standard in the art, and further having a longitudinal centerline 17. Annular surface 14*a* of shaft 14 extends upwardly, as shown in FIG. 3, from butt 16 and has a slight inward slope so that shaft 14 is generally more narrow nearer to its end having a tip than at butt 16.

Shaft 14 comprises striking end region 15, having a ferrule-tip 12 (i.e., a ferrule that is the tip), being a combined ferrule and tip with a rounded resilient hemispherical crown or end 40 for striking purposes. With respect to the present invention, a conventional tip made of wood, rubber or any other material is omitted. Cylindrical surface 12*a* of ferrule-tip 12 extends upwardly to form rounded end 40 (i.e. a striking tip). In other words, unlike a conventional cue stick, ferrule-tip 12 is the tip for striking purposes in the present invention. Ferrule-tip 12, which includes rounded striking tip 40, is a single piece with a rounded tip 40. Ferrule-tip 12, having a threaded screw 20 discussed below, has a threaded bore to be screwed onto screw 20, as also discussed below. Ferrule tip 12 is a cylindrical member comprising a phenolic ferrule combination, such as a C-grade phenolic. Of course ferrule-tip 12 can alternatively comprise any other resilient material, which can be a plastic such as polyethylene, polypropylene, polycarbonate, acrylic, DELRIN®, acetal, Teflon®, nylon, phenolic, such as C-grade phenolic, ABS, vinyl, PVC, VIVAK®, a hard, rubber, or leather, all of which are conventional in the art. The only time leather would work is if it were very thin and covers a hard ferrule so that the energy being transferred is from the ferrule underneath the leather. Ferrule-tip 12 comprises a cylindrical outer surface 12*a* having a longitudinal centerline being in alignment with the longitudinal centerline of shaft 14, thereby causing outer surface 14*a* and outer surface 12*a* to be aligned. Screw 20 is preferably ½ inch long with 5/16—18 threads, and the bore of ferrule tip 12 has mating threads. Ferrule-tip 12 can be permanently affixed to shaft 14 without a threaded screw as well, such as by securing ferrule-tip 12 to a tenon extending upwardly from shaft 12 in the same manner as threaded screw 20 and stabilizing ferrule-tip 12 thereon by any manner conventional in the art, such as by glue. Such a method of permanently securing a ferrule to the shaft is known in the art and so a more detailed description thereof is herewith omitted for the sake of brevity.

Figure 3:
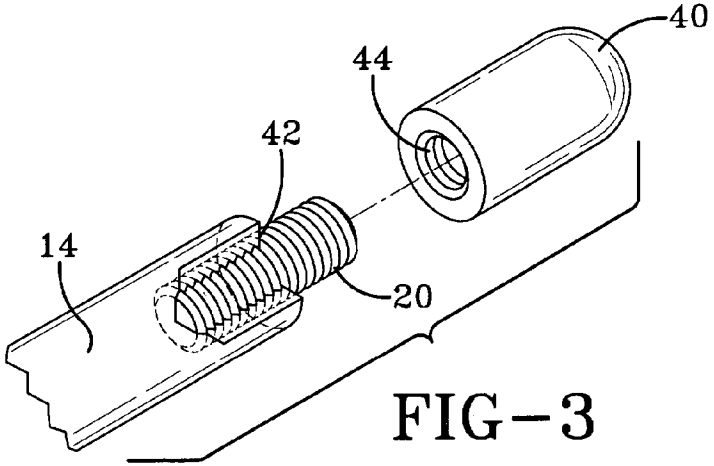
FIG. 3 is an exploded view of the engagement or joint between the shaft of the jump shot device and the striking end or ferrule as shown in FIG. 1.

Referring now to FIG. 3, as stated supra, shaft 14 comprises a first threaded screw or pin 20. Threaded screw 20 extends upwardly out of shaft 14 and threadingly engages with ferrule-tip 12 to a depth of about 0.5 inch via a threaded bore 44 at the bottom end of ferrule-tip 12, thereby allowing ferrule tip 12 to be engaged with shaft 14 for operation. Pin 20 can be made of any type of metal or plastic commonly used for such purposes in the art.

Figure 4:
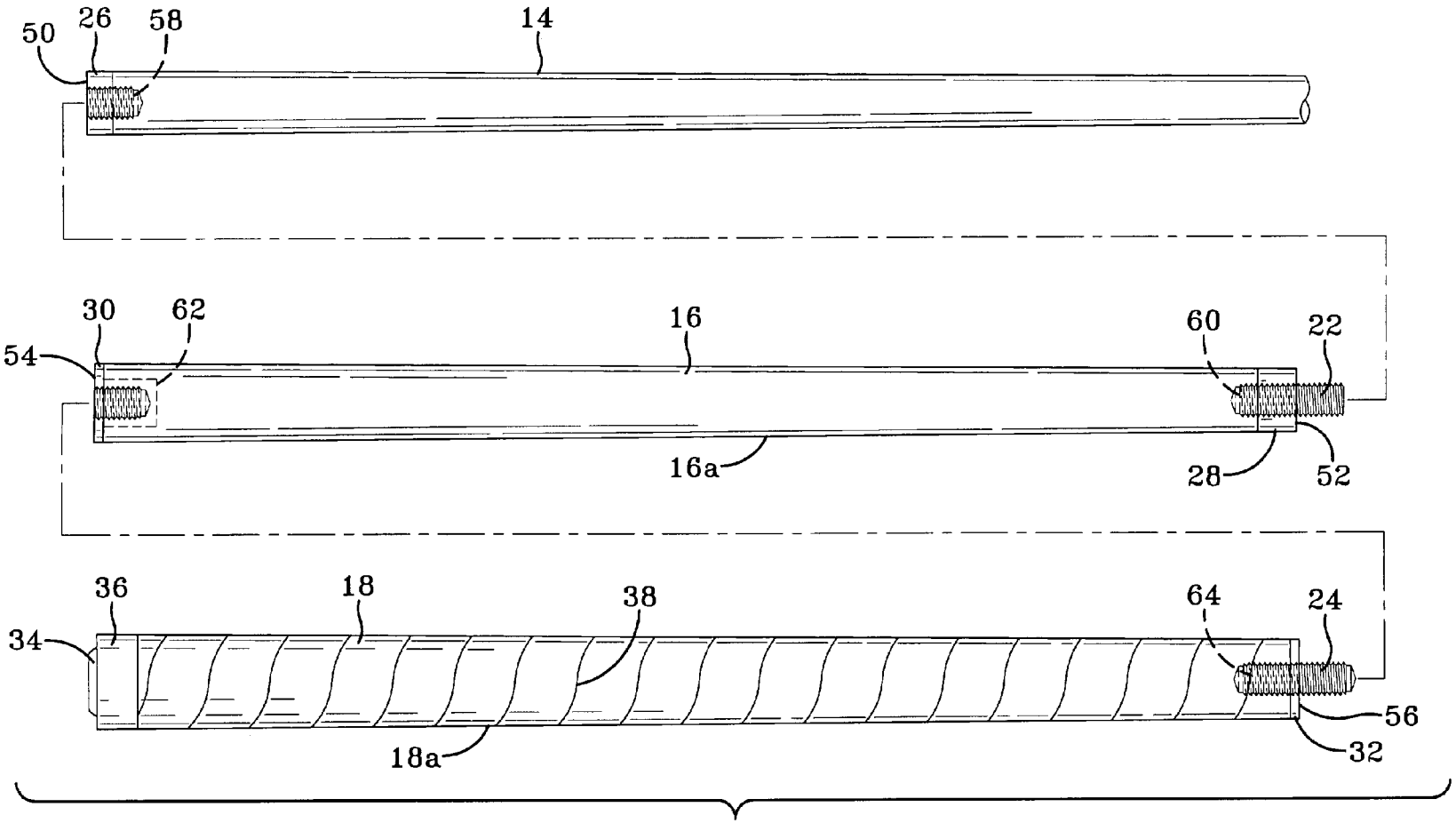
FIG. 4 is a side view of the jump shot device, being disengaged, as shown in FIG. 1.

Turning now to FIG. 4, shaft 14 is shown in alignment with butt 16 and handle 18. Shaft 14, butt 16 and handle 18 are typical of those found in this type of sport, such as having an annular outer surface 16*a* and 18*a*, both having a longitudinal centerline aligned with that of shaft 14 and being made of hard, finished wood such as maple, curly birdseye maple, or the like. Additionally, handle 18 or both handle 18 and butt 16 can include a wrap 38. Wrap 38 can be threaded onto device 10 and provides a tight and secure grip for the player. Wrap 38 may be made of any material common in the art, such as leather, Irish linen or nylon, which can be tightly held and can accommodate the sweat of the player.

Shaft 14 and butt 16 engage at first joint 46, which is a flat-face connection (FIG. 1). First joint 46 comprises a first phenolic ring 26 at the base of shaft 14 and a second phenolic ring 28 at the upper portion of butt 16. Base of shaft 14 further includes a hole 50 that is aligned with a hole 52 in the upper portion of butt 16. Holes 50 and 52, which are preferably threaded and include a phenolic insert 58 and 60 respectively, receive a second pin 22, which is also preferably threaded thereby facilitating the engagement between shaft 14 and butt 16. A variety of pins are employed in the use of joints of cues to provide different types of hits during use. Preferably, a ⅜—10 pin is used, but any other type of appropriate pin can also be employed.

Figure 5:
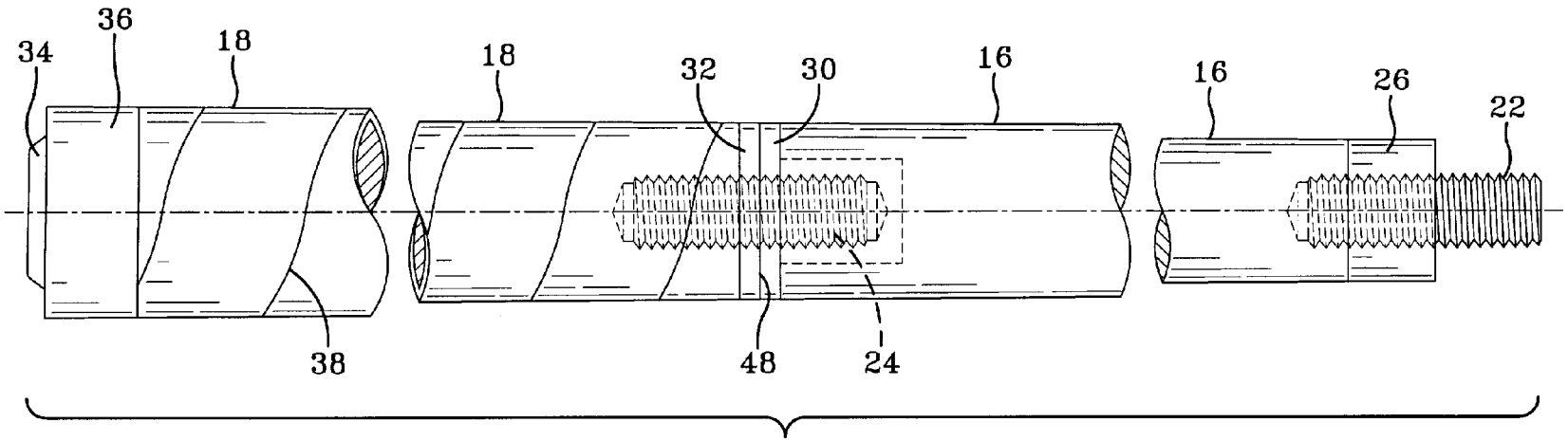
FIG. 5 is a side view of the butt and handle of the jump shot device, being engaged, as shown in FIG. 1.

Butt 16 and handle 18 are engaged at a second joint 48 (FIG. 1) in the same manner as that described above for the engagement between shaft 14 and butt 16 at first joint 46. Second joint 48 includes a third and fourth phenolic ring 30, 32, a butt bottom end hole 54 with a phenolic insert 62 and a handle top end hole 56 with a phenolic insert 64. A third pin 24, which is preferably of the same type as that used in second joint 48, is threadingly inserted into inserts 62 and 64 and engages butt 16 with handle 18 (FIG. 5). Of course second joint 48 can be excluded so that device 10 comprises only a centrally located joint connecting shaft 14 to handle 18.

Device 10 may further include a fifth phenolic ring at the base of handle 18 and a rubber bumper 34 on the underside of handle 18, both of which are commonly employed in the art.

Figure 6:
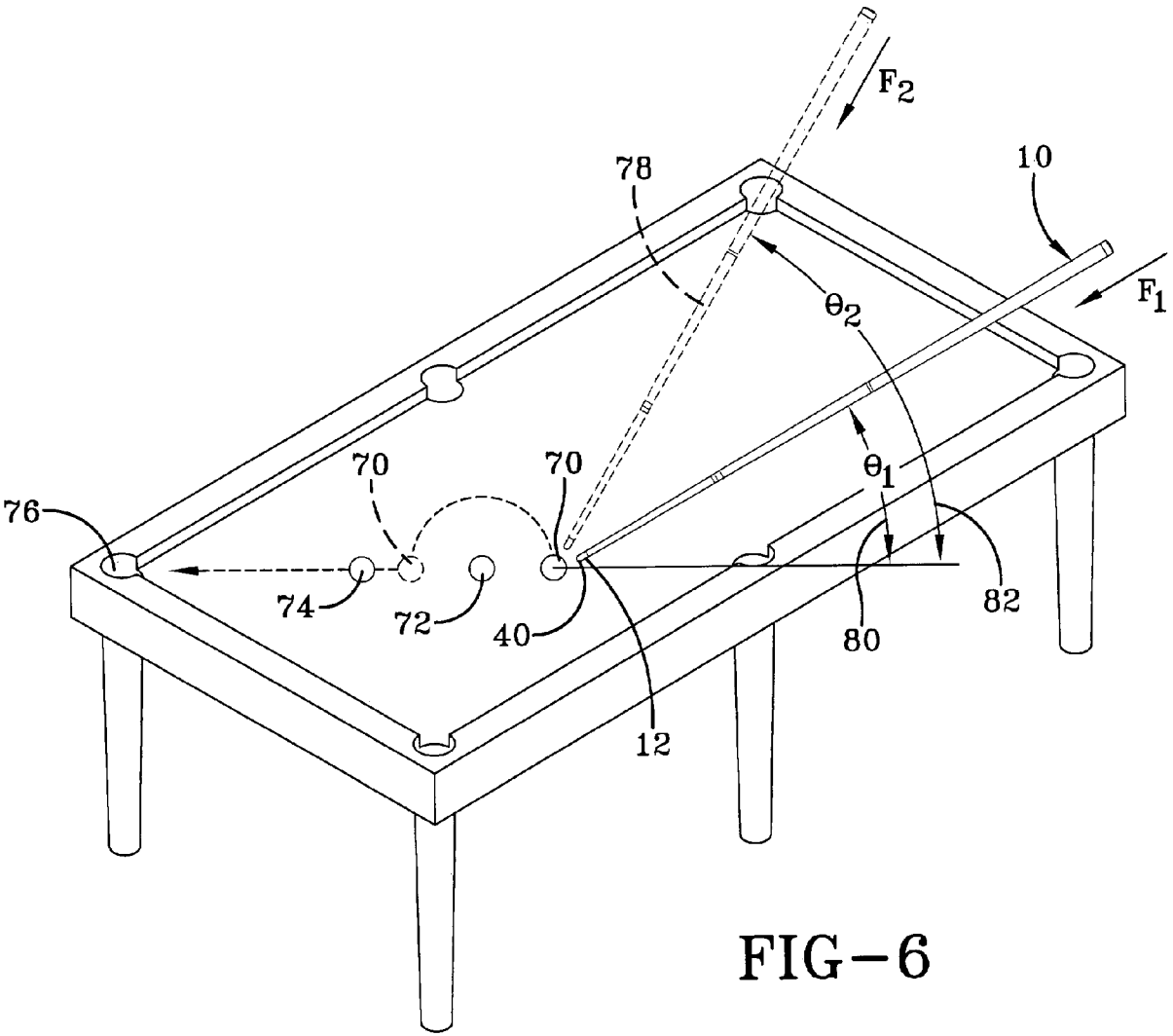
FIG. 6 is a side view of the cue stick of the present invention during the course of play.

Turning lastly now to FIG. 6, cue stick 10 of the present invention is shown being used to jump a cue ball 70 over an obstructing ball 72 during the course of play. As is shown in FIG. 6, the player (not shown) holds cue stick 10 at an advantageous angle 80, which is the angle created at the intersection of longitudinal centerline 17 with the plane of the top of the billiard table. Angle 80 created when using cue 10 to jump cue ball 70 is represented as $\Theta_1$. The player strikes cue ball 70 with cue stick 10 at angle 80 with an advantageous amount force ($F_1$) in a simultaneous downwardly and forwardly direction. Upon striking cue ball 70, cue ball 70 "jumps" over obstructing ball 72 and strikes a target ball 74 thereby ideally causing target ball 74 to be moved into a target pocket 76 or elsewhere on the table.

This is shown in contrast to using a conventional cue stick, illustrated in ghost form at numeral 78. When using conventional stick 78 to "jump" cue ball 70 over obstructing ball 72 in the same given situation, stick 78 necessitates a greater angle of elevation 82 ($\Theta_2$) and a greater amount of force ($F_2$). Although using conventional stick 78 rather than stick 10 of the present invention may accomplish the same ultimate goal of placing target ball 74 into pocket 76 (or at another desired location), the chance of doing so is decreased by using stick 78 due to the more difficult shot having a greater elevated angle. In addition, the chance of damage caused to either the table or the stick itself, or both, is increaesd. Both decreased force employed and decreased elevated angle for causing cue ball 70 to jump over obstructing ball 72 are due to stick 10 employing a striking end 50 having ferrule-tip 12.

The invention has been described with particular reference to cues for playing pool. The features of the invention could also be used for similar games such as billiards, snooker, bumper pool and the like. What has been described above are preferred aspects of the present invention. It is of course not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, combinations, modifications, and variations that fall within the spirit and scope of the appended claims.

What is claimed is:

1. A jump/break cue for jumping a cue ball and for breaking a rack of pool balls, said jump/break cue comprising:

a shaft having a striking end region and a second end, wherein said shaft is progressively tapered so as to be more narrow towards said striking end region than said second end, said shaft comprising a tenon extending in one direction from said striking end region; and a one-piece ferrule-tip permanently disposed on said tenon of said striking end region of said shaft, said ferrule-tip comprising a cylindrical body extending in the one direction to form a hemispherically rounded crown and bore for permanently attaching said ferrule-tip to said tenon, said crown serving as the striking tip for a selected one of striking a cue ball and causing the cue ball to jump in response to the cue being inclined relative to a table where the cue ball is resting or driving the cue ball into a rack of balls to break the rack, wherein said ferrule-tip is made of a material having a hardness of 100 on the Shore-D scale.

2. The jump/break cue according to claim 1, wherein said material is ABS.

3. A jump/break cue according to claim 1 wherein said tenon has a threaded pin extending from the shaft, the bore of said ferrule-tip is threaded to mate with said threaded pin to permanently attach said ferrule-tip to said tenon.

* * * * *